US009163789B2

(12) United States Patent
Lin

(10) Patent No.: US 9,163,789 B2
(45) Date of Patent: Oct. 20, 2015

(54) ATTACHMENT BASE FOR A LIGHTING UNIT OF A DECORATIVE LIGHTING STRING

(71) Applicant: De-Hui Lin, Zhubei (TW)

(72) Inventor: De-Hui Lin, Zhubei (TW)

( * ) Notice: Subject to any disclaimer, the term of this patent is extended or adjusted under 35 U.S.C. 154(b) by 305 days.

(21) Appl. No.: 13/941,548

(22) Filed: Jul. 15, 2013

(65) Prior Publication Data

US 2015/0016125 A1 Jan. 15, 2015

(51) Int. Cl.

| | |
|---|---|
| ***F21V 21/08*** | (2006.01) |
| ***F21K 99/00*** | (2010.01) |
| ***F21S 4/00*** | (2006.01) |
| ***F21V 19/00*** | (2006.01) |
| *F21W 121/00* | (2006.01) |
| *F21Y 101/02* | (2006.01) |

(52) U.S. Cl.

CPC ... *F21K 9/30* (2013.01); *F21S 4/00* (2013.01); *F21V 19/004* (2013.01); *F21W 2121/00* (2013.01); *F21Y 2101/02* (2013.01)

(58) Field of Classification Search

CPC ..... F21K 9/30; F21W 2121/00
USPC ..... 362/396, 391, 653, 654, 655; 313/318.01; 439/168

See application file for complete search history.

(56) References Cited

U.S. PATENT DOCUMENTS

| | | | | |
|---|---|---|---|---|
| 8,827,728 | B1 * | 9/2014 | Lin | 439/168 |
| 2009/0045717 | A1 * | 2/2009 | Cavallaro et al. | 313/318.01 |
| 2011/0122613 | A1 * | 5/2011 | Hsu | 362/231 |

* cited by examiner

*Primary Examiner* — Karabi Guharay
(74) *Attorney, Agent, or Firm* — Leong C. Lei

(57) ABSTRACT

The present invention provides an attachment base for a lighting unit of a decorative lighting string comprising an upper base member inserted with an LED lamp and mounted onto an lower base member; the upper base member comprising locking hooks extended downward from two lateral sides of a bottom portion thereon; the lower base member comprising buckle holes adjacent to a bottom portion on two lateral sides corresponding to the locking hooks; characterized in that inner bottom surfaces of rear of the two buckle holes on the lower base member comprise blocking plate; a distance between the blocking plate and the buckle hole is slightly greater than a thickness of the locking hook. With such blocking plates, once the locking hooks are secured onto the buckle hole, the locking hooks abut the blocking plate to prevent the looking hook to disengage from the buckle hole under external forces.

1 Claim, 2 Drawing Sheets

ATTACHMENT BASE FOR A LIGHTING UNIT OF A DECORATIVE LIGHTING STRING

TECHNICAL FIELD OF THE INVENTION

The present invention is related to an attachment base for a lighting unit of a decorative lighting string, in particular, to an improved design of an attachment structure of an upper base member and a lower base member of a lighting base of an LED lighting string.

DESCRIPTION OF THE PRIOR ART

As one may know that there are various types of LED lighting strings similar to the one of the present invention in the current market, among such large amount of different lighting strings, their attachment bases for the lighting units typically consist of an upper base member and a lower base member while the upper base member and the lower base member are attached to each other with locking hooks and buckle holes formed in the upper base member and the lower base member. However, such locking method of the locking hook and the buckle hole has its drawbacks. Since the locking hook is made of plastics such that the locking hook is of certain elasticity, during the time when the locking hook is locked onto the buckle hole, the locking hook can be unfavorably shifted in position due to external forces caused by compression or vibration and then disengaged from the securement with the buckle hole. In view of such drawback, there is a need to provide an improvement to overcome the known inadequate structure associated with the unfavorable disengagement of the attachment base of the lighting unit of the lighting string as a whole such that the proper function and operation thereof can be achieved.

SUMMARY OF THE INVENTION

To overcome the aforementioned drawback associated with the attachment base of the lighting unit of known light string, the present invention utilizes a clamping method to achieve a tight securement between the locking hook of the upper base member and the buckle hole of the lower base member once the upper base member is mounted onto the lower base member of the lighting unit in order to eliminate any undesirable disengagement between the two.

To achieve the aforementioned objectives, the present invention provides an attachment base for a lighting unit of a decorative lighting string, comprising an upper base member inserted with an LED lamp thereon and mounted onto an lower base member; the upper base member further comprising locking hooks extended downward from two lateral sides opposing to each other on a bottom portion thereon; the lower base member further comprising buckle holes arranged adjacent to a bottom portion thereof and on two lateral sides corresponding to the locking hooks; characterized in that inner bottom surfaces of rear portions of the two buckle holes on the lower base member comprise a blocking plate respectively and a distance between the blocking plate and the buckle hole is slightly greater than a thickness of the locking hook such that with the design of the blocking plate and once the locking hooks of the upper base member are secured onto the buckle holes of the lower base member, the locking hooks are able to abut the blocking plate in order to prevent the looking hook to disengage from the securement with the buckle hole caused by external forces.

DETAILED DESCRIPTION OF THE PREFERRED EMBODIMENTS

Figure 1:
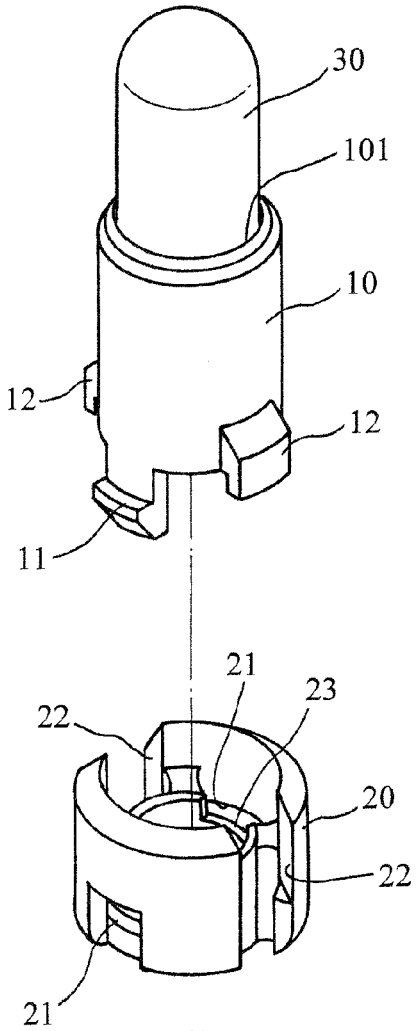
FIG. 1 is an exploded view of the structure of the present invention.
Figure 2:
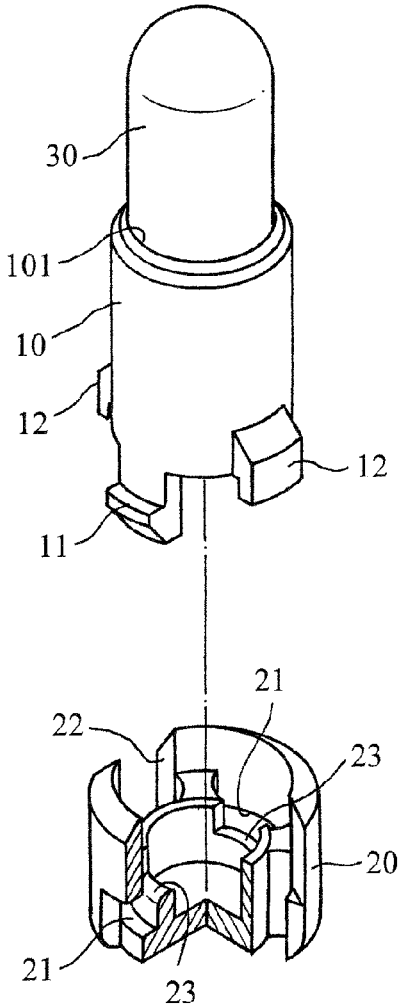
FIG. 2 is another exploded view of the structure of the present invention.
Figure 4:
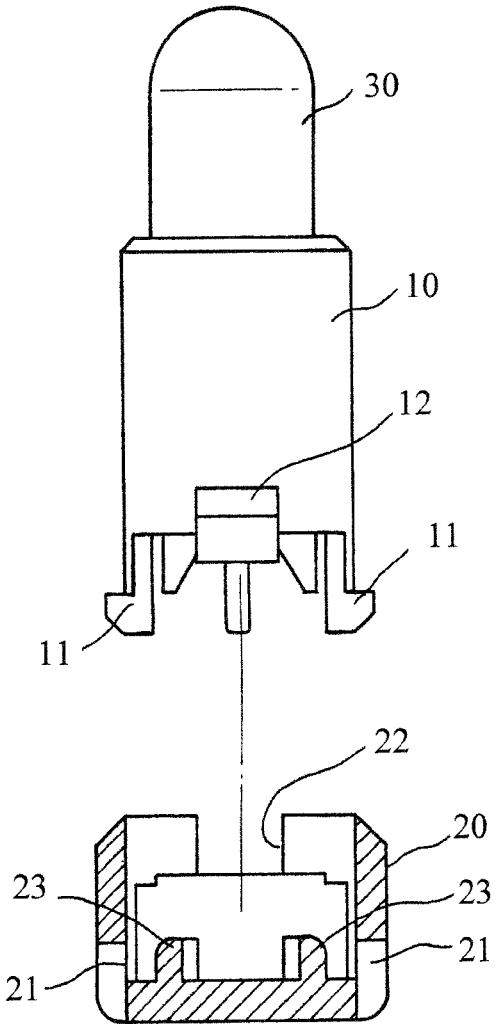
FIG. 4 is a cross-sectional view of the exploded view of the present invention.

As shown in FIG. 1, FIG. 2 and FIG. 4, the present invention provides an attachment base for a lighting unit of a decorative lighting string comprising an upper base member (10), a lower base member (20) and an LED lamp (30). An upper portion of the upper base member (10) comprises a receiving slot (101), and the LED lamp (30) is inserted into the receiving slot (101). The upper base member (10) further comprises outwardly protruded locking hooks (11) extended downward from two lateral sides opposing to each other on a bottom portion thereof respectively and the bottom portion further comprise positioning blocks (12) protruded on another two lateral sides opposing to each other respectively. The lower base member (20) comprises a top opening and buckle holes (21) having a dimension slightly greater than that of the locking hooks (11) and provided on two lateral sides corresponding to the locking hooks of the upper base member (10) respectively. The lower base member (20) further comprises positioning slots (22) having a width slightly greater than that of the positioning blocks (12) and provided on two lateral sides corresponding to the positioning blocks (12) of the upper base member (10) respectively. In addition, inner bottom surfaces of rear positions of the two buckle holes (21) of the lower base member (20) further comprise a blocking plate (23) respectively, and a distance between the blocking plate (23) and the buckle hole (21) is slightly greater than a thickness of the locking hooks (11) of the upper base member (10).

Figure 3:
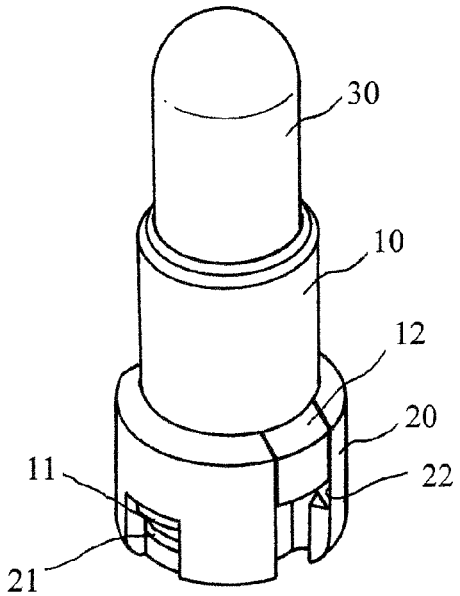
FIG. 3 is a perspective view of the assembly of the present invention.
Figure 5:
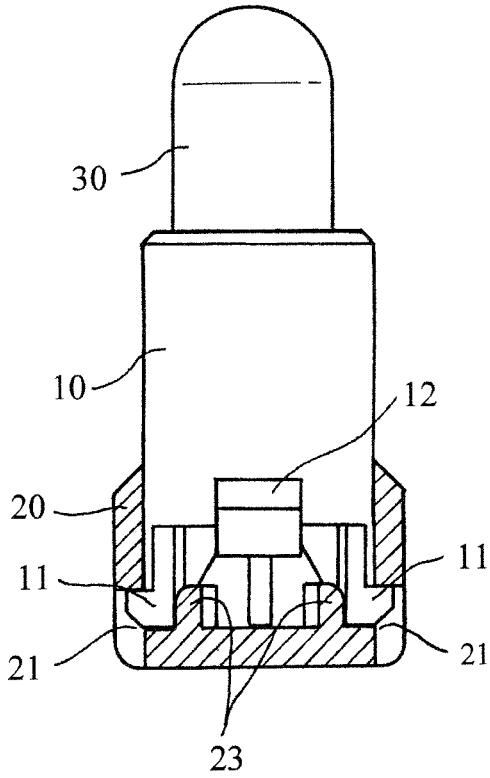
FIG. 5 is a cross-sectional view of the assembly of the present invention.

As shown in FIG. 3 and FIG. 5, once the upper base member (10) is attached with the LED lamp (30), it can be inserted into the opening of the lower base member (20) with the positioning blocks (12) on the bottom portion thereof cooperating structurally with the positioning slots (22) of the lower base member (20). In addition, the protrusions of the locking hooks (11) of the upper base member (10) are locked into the buckle holes (21) along with the two blocking plates (23) of the lower base member (20) respectively, during which, the rear portions of the locking hooks (11) abut the blocking plates (23) such that the locking hooks (11) can be maintained in a state of being tightly secured onto the buckle holes (21). As a result, the locking hooks (11) cannot be shifted in position under such as external pushes, forces or strong vibrations exerted on the locking hooks (11) and such that it is able to prevent securement disengagements caused by external forces.

What is claimed is:

1. An attachment base for a lighting unit of a decorative string, comprising an upper base member, a lower base member and an LED lamp; a top portion of the upper base member comprising a receiving slot on provided for an LED lamp to be inserted therein; the upper base member further comprising an outwardly protruded locking hook extended outward from two lateral sides opposing to each other on a bottom portion thereof respectively and the bottom portion comprising a positioning block protruded on another two lateral sides opposing to each other respectively;

the lower base member comprising a top opening and buckle holes arranged adjacent to a bottom portion thereof and corresponding to the locking hook of the upper base member respectively; the lower base member further comprising a positioning slot provided on two lateral sides corresponding to the positioning block of the upper base member respectively; characterized in that:

inner bottom surfaces of rear locations of the two buckle holes of the lower base member comprise a blocking plate respectively; a distance between the blocking plate and the buckle hole is slightly greater than a thickness of the locking hook and such that with the blocking plates, once the locking hooks of the upper base member are secured onto the buckle holes of the lower base member, the locking hooks abut the blocking plates to prevent the locking hooks to disengage from securement with the buckle hole caused by external forces.

* * * * *